United States Patent [19]

Jackson, III et al.

[11] 4,050,759

[45] Sept. 27, 1977

[54] ZERO-INSERTION-WITHDRAWAL FORCE CONNECTOR

[75] Inventors: Robert Andrew Jackson, III, Evanston; Harry G. Willis, Plainfield, both of Ill.

[73] Assignee: Motorola, Inc., Schaumburg, Ill.

[21] Appl. No.: 689,431

[22] Filed: May 21, 1976

[51] Int. Cl.[2] ..... H01R 13/54

[52] U.S. Cl. ..... 339/75 M; 339/175 C

[58] Field of Search ..... 339/75 R, 75 M, 91 R, 339/175 M

[56] References Cited

PUBLICATIONS

Ross, T., *Test Socket,* IBM Technical Disclosure Bulletin, vol. 10, No. 5, pp. 549–550, October 1967.

*Primary Examiner*—Roy Lake
*Assistant Examiner*—E. F. Desmond
*Attorney, Agent, or Firm*—James W. Gillman; Victor Myer

[57] ABSTRACT

A zero-insertion-withdrawal force connector is disclosed. The contact fingers thereof are arranged in two series at right angles to each other. By a single movement in one direction of an operating lever two cam, or actuating, motions are produced for causing, essentially simultaneous, engagement of two series of contact fingers.

7 Claims, 3 Drawing Figures

10
11
12
13
14
15
16
17
18
19
21
22
23
24
25
26
27
28
29
31
32
33
34
35
36
37
38
39
41
42
43
44
46
47
48
49
52
53
54
55
56
57
58
59
61
62
63
64
65
66
73
74
75
76
77
78
79
81
82
83
84
85
86
87
88
89
91
92
93
94
95
96
99
101
102
103
104
105
105A
106
107
108
109
111
112
113
114
115
116
117
118
119
121
122
123
126

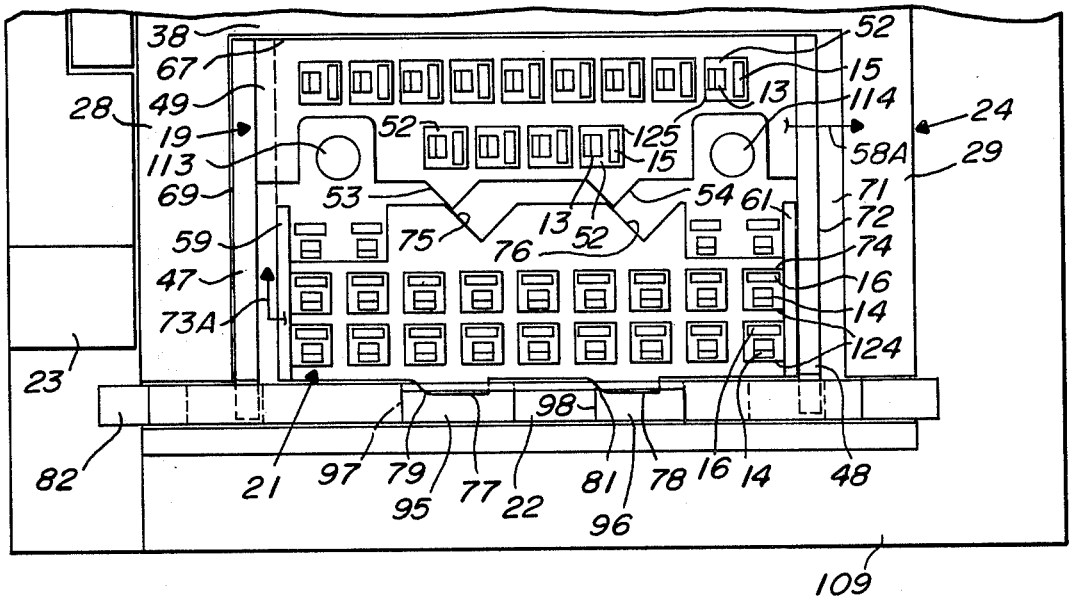
Fig. 2
Fig. 3
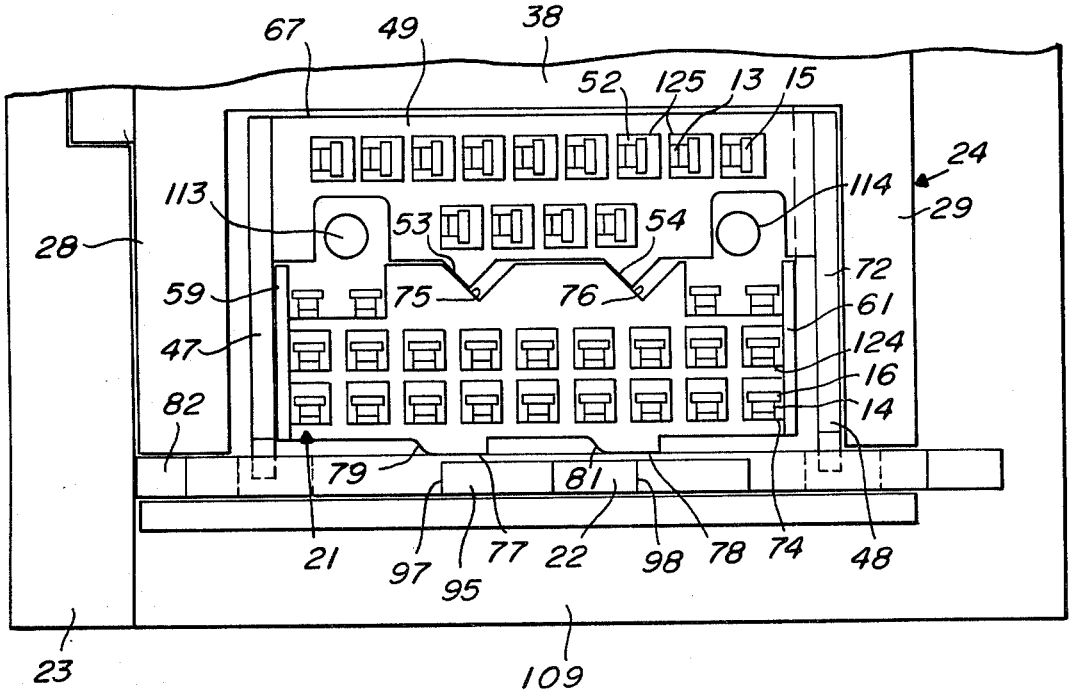

ZERO-INSERTION-WITHDRAWAL FORCE CONNECTOR

BACKGROUND OF THE INVENTION

This invention relates to connectors for terminating multi-wire cables, as for example, in radio packages, wherein the appropriate wires of two cable parts may be terminated and connected together by means of the connector. More particularly the invention relates to such structures wherein the terminal parts of connectable multi-wire cables may be joined, that is to say one part mechanically inserted into another and withdrawal therefrom, with zero insertion and withdrawal force. After insertion, the holding force must be adequate to hold the parts together.

Zero insertion and withdrawal force connectors are known to the art. These devices typically have male and female type terminals, or contacts, wherein the contact is made to all of the contact members by moving the contact holder in some particular direction. The wires or conductors connected to the contacts are therefore always subject to some bending stress at each operation of the connector whether it is being inserted or removed. Ultimately of course, this can result in one or more of the conductors being broken away from the appropriate contact member.

Prior art zero-insertion-withdrawal force connectors have had their contact members all oriented in the same direction, that is, lying in the same or parallel planes. In such construction, it is necessary that some means be provided for orienting the two connector parts so that one is inserted into the other always with the proper orientation. That is to say some form of polarizing means must be provided. Thus in the prior art constructions it was necessary that the camming or similar means for holding the two connector parts together had to move one connector part in a single direction or in one plane only.

According to the invention these disadvantages of the prior art are eliminated, and the structure which holds the contact members is not moved at all but cam actuated members are provided for moving the contacts in the appropriate direction. Bending stresses on the connecting conductors are thereby completely avoided. The contact members or fingers are disposed into groups, the planes of the contact members in one group are at right angles to the planes of the contact members in the other group. In this way an automatic polarization or orientation scheme is provided and no specific means need be provided for this purpose. By shifting the moveable contact members of one connecting part to engage the cooperating corresponding contact members of the other connecting part contact wiping action is achieved without the common contact wear characteristics which may enable lower plating costs through the usage of non-precious metal plating, or reduced precious metal plating thickness.

SUMMARY OF THE INVENTION

It is an object of the invention to provide an improved zero-insertion and withdrawal force connector which eliminates the objections of prior art devices.

It is a further object of the invention to provide an improved zero-insertion and withdrawal force connector having contact fingers disposed in planes at right angles to each other and providing means whereby contact engaging movements at right angles to each other are achieved by a single motion actuating means.

It is a further object of the invention to provide an improved connector of the nature indicated which is simple to construct and efficient in operation.

In carrying out the invention according to one form there is provided a zero-insertion-withdrawal force connector assembly comprising a first connector block having first and second contact fingers projecting therefrom, the planes of said first contact fingers being disposed at right angles to the planes of said second contact fingers, a second connector block having third and fourth contact fingers projecting therefrom the planes of said third contact members being disposed at right angles to the planes of said fourth contact fingers, said second connector block being adapted to be disposed adjacent said first connector block with said third contact fingers lying alongside said first contact fingers but out of contact therewith and with said fourth contact fingers lying along said second contact fingers but out of contact therewith, single cam actuating means, and means actuated by said single cam for causing said first and said third contact fingers to engage each other and said second and fourth contact fingers to engage each other.

In carrying out the invention according to a second form there is provided a zero-insertion-withdrawal force connector assembly comprising a first connector block having first and second contact fingers projecting therefrom, the planes of said first and second contact fingers being disposed at right angles to the plane of said second contact fingers, a second connector block having third and fourth contact fingers projecting therefrom, the planes of said third contact fingers being disposed at right angles to the planes of said fourth contact fingers, said second connector block being adapted to be disposed against said first connector block with said third contact fingers lying alongside said first contact fingers but out of contact therewith and with said fourth contact fingers lying alongside said second contact fingers but out of contact therewith, first means for moving said first and third contact fingers into engagement with each other in one direction, second means for moving said second and fourth contact fingers into engagement with each other at right angles to the movement of said first means, interengaging means between said first means and said second means for moving said first means at right angles to the movement of said second means when said second means is moved, and third means for moving said second means.

BRIEF DESCRIPTION OF THE DRAWINGS

FIG. 2 is a view, partially broken away, and taken substantially in the direction of arrows 2—2 of FIG. 1 showing the operating parts in an unlocked condition; and FIG. 3 is a view similar to FIG. 2 with the operating parts in a locked condition.

DESCRIPTION OF THE PREFERRED EMBODIMENT

Figure 1:
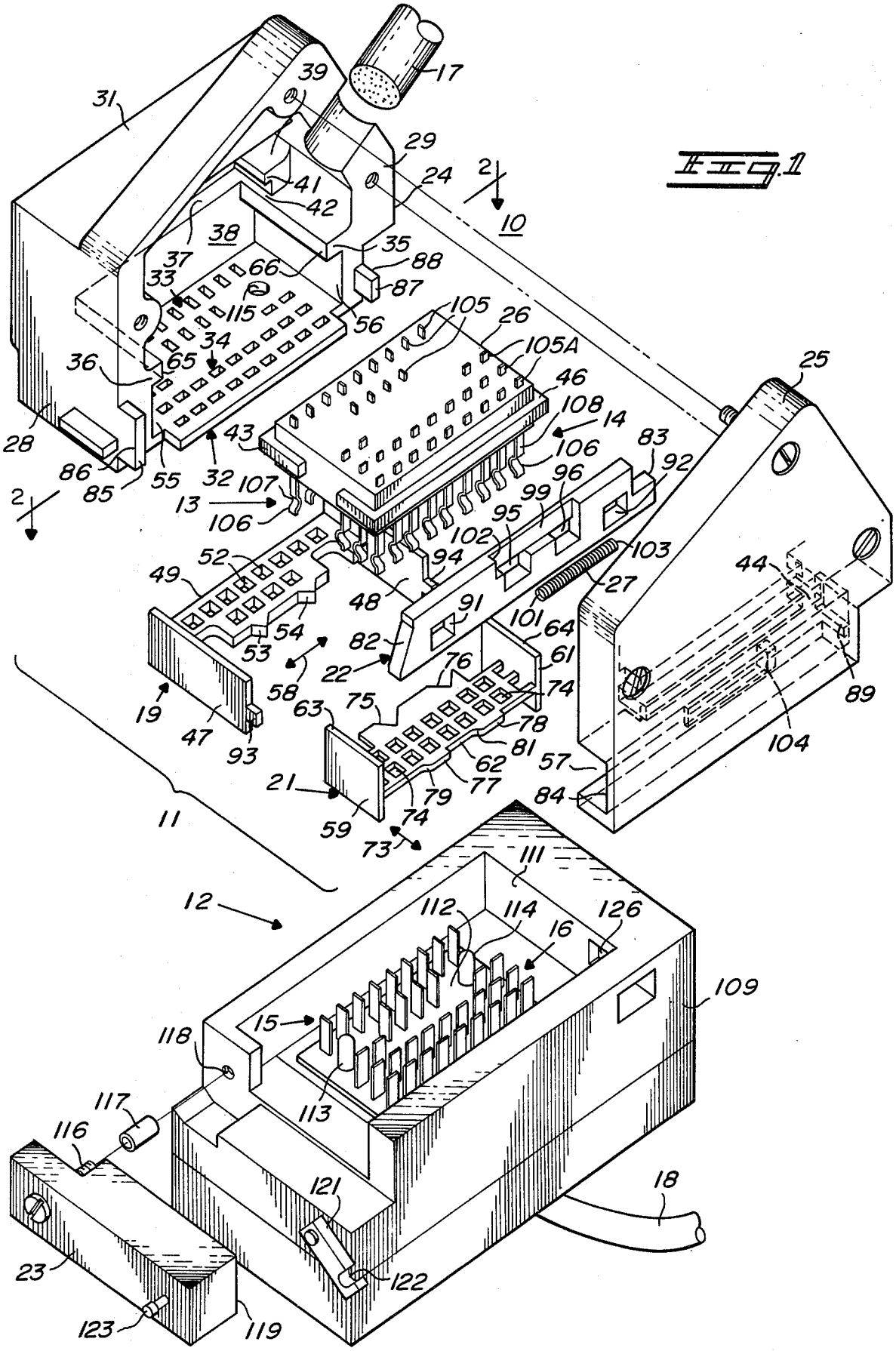
FIG. 1 is an exploded perspective view of a connector according to the invention.

Referring to the drawings there is shown a zero insertion and withdrawal force connector 10 having, in effect, a female part 11 and a male part 12. When the various pieces, as will be described, are assembled and the female and male parts 11 and 12, respectively, connected together, the series of fingers 13 and 14 will be connected to the series of fingers 15 and 16, respectively, to create contact between individual ones of the conductors disposed in the connecting cables 17 and 18. The contact fingers 13 and 14 are disposed in planes at right angles to each other and, correspondingly, the contact fingers 15 and 16 are disposed in planes at right angles to each other, the fingers 13 and 15 being disposed in parallel planes and the contacts 14 and 16 being disposed in parallel planes.

When the female part 11, in its assembled condition, is connected to the male part 12, the two parts go together with zero force and are withdrawn from each other with zero force unless the cam mechanism which may comprise the parts 19, 21, 22 and 23 is actuated, as will be described.

The female part comprises a housing 24, a cover 25, a female contact finger holder 26, the cam parts 19, 21, 22 and a spring 27.

The housing 24 may be an integrally molded part for example of synthetic material such as nylon having end walls 28 and 29, a top 31 and a bottom 32. The bottom 32 has two series of rectangular holes 33 and 34 at right angles to each other and adapted to receive the two series of male contact fingers 15 and 16, respectively, of male part 12.

Extending inwardly from the ends 24 and 28 are ledges 35 and 36, respectively, terminating in a ledge 37 at the rear surface 38 of the housing. Directly above the ledge 35 at the rear surface 38 is an abutment 39 from which extends the lip 41. Interiorly of the end 28 there is a similar abutment and a similar lip not shown. The lip 41 and the upper surface of ledge 35 form a groove 42 within which the right hand ledge 43 of contact finger holder 26 is received when the contact finger holder is disposed interiorly of the housing 24. Similarly of course there is a corresponding slot (not shown) at the end 28 which receives the left hand of ledge 43 of contact finger holder 26. The lower surface of ledge 43, of course, is supported on the ledges 35 and 36. A groove 44 is disposed on the interior surface of the cover 25 and receives the ledge 46 along the three sides of the contact finger holder 26 when these parts are assembled together. The contact finger holder 26 is thus held firmly in a fixed position.

The cam part 19 comprises end pieces 47 and 48 between which extends a bridge piece 49 all of which may comprise an integrally molded part of insulating synthetic materials such as nylon for example. The bridge piece 49 includes a series of rectangular holes or openings 52 which when piece 19 is in position will cooperate with the series of rectangular openings 33 in the bottom surface 32 of the housing 24. Ordinarily there will be one square opening 52 for each rectangular opening for slot 33. Forwardly of the bridge piece 49 is a pair of angular cam surfaces 53 and 54. The piece 19 is adapted to fit into the housing 24 with the end piece 47 disposed in the rectangular groove 55 between the ledge 36 and the bottom 32, and the end 48 in the groove 56 between the ledge 35 and the bottom 32, the rear edge of bridge member 49 being disposed against the inner surface of the rear wall 38 of housing 24. The height of end members 47 and 48 is such that these members can easily slide in the grooves 55 and 56 and the lengths of end members 47 and 48 is such that these members extend forwardly of the housing 24 and into the rectangular groove 57 interiorly of the cover 25. The length of the bridge member 49 is such that the cam piece 19 can move longitudinally, in either direction, as shown by the double ended arrow 58, within the slots 55 and 56.

The cam piece 21 comprises end members 59 and 61 separated by a bridge member 62. The end members 59 and 61 are spaced apart by the bridge member 62 so as to be positionable between the interior surfaces of end members 47 and 48 of cam part 19. In addition, the end members 59 and 61 are of such dimensions as to rest on the bottom member 32 and at the same time have the upper edges 63 and 64, respectively, of end members 59 and 61 bear against the inner edges 65 and 66 respectively of the ledges 36 and 35. Thus, when assembled, as may be seen best in FIG. 2, the cam piece 19 is disposed with the rearward edge 67 of the bridge member 49 disposed against the inner surface of wall 38, with the left hand surface 69 of end piece 47 disposed against the inner surface of the end wall 29 and leaving a space 71 between edge 72 of the end member 48 and the inner surface of wall 29, thereby providing room for the cam piece 19 to move from left to right as shown by double headed arrow 58. The cam piece 21 being confined by its end members 59 and 61 between the inner surfaces 65 and 66 of the ledges 36 and 35 can only move inwardly and outwardly according to the double ended arrow 73.

The bridge member 62 of cam piece 21 is provided with a series of square openings 74 within which are received individual ones of a vertically extending male contact members 16 and also individual ones of the downwardly extending female contact fingers 14 but out of contact with the individual members 16. At the inner edge of the bridge member 62 there are slots which include cam surfaces 75 and 76 which bear against the cam surfaces 53 and 54 respectively of cam piece 19.

At the front surface of bridge member 62 are projections 77 and 78 at the left hand edges of which are angled or cam surfaces 79 and 81, respectively. The cam piece 19 may, for example, be made of some insulating material such as nylon in order that no short circuiting of the various contact will take place during actuation.

The cam piece 22, or actuator, may comprise an elongated metallic bar having an angular, or cam actuating surface 82 at one end and a projecting guide lug 83 at the other end. The cam piece 22 is adapted to ride against the inner surface 84 of the slot 57 and is confined thereto by the edge 85 of the projecting lug 86 (housing 24) which is received within the left end of slot 57 and the end 87 of the projecting lug 88 (housing 24) which is received in the reduced size of slot 57 at the right hand end 89 of the cover 25.

The cam piece 22, or operator, includes slots 91 and 92 for receiving, respectively, the end lugs 93 and 94 of the end pieces 47 and 48, respectively, of cam piece 19. The end surfaces of end members 47 and 48, respectively, which terminate in the lugs 93 and 94 bear against the inner surface of cam member 22 and aid in controlling the motion of this member in the slot 57 as described. In addition, the cam piece 22 includes the rectangular slots 95 and 96, the left hand edges of which 97 and 98 (FIG. 2), respectively, bear against the cam surfaces 79 and 81, respectively, for causing the piece 21 to move inwardly in the direction 73A of the double ended arrow 73 whenever the cam piece is moved toward the right as viewed in FIGS. 1 and 3. A slot 99 is formed in the rearward surface of cam piece 22 for receiving the biasing spring 27 which has one end 101 bearing against the end surface 102 of slot 99, the other end 103 of biasing spring 27 bearing against an abutment 104 interiorly of the slot 57, so that the cam piece 22 is biased toward the left as viewed in the figures.

The various parts of the female connector member 11 are disposed together in one unit as may be visualized in FIG. 1 and in FIGS. 2 and 3. Individual conductors may be envisaged connected to the female contact fingers 105 (13) and 105A (14) shown as groups. The female contact fingers 105 of the series 13 extend downwardly through individual ones of the rectangular openings 52 and the female contact fingers 105A of the series 14 extend downwardly through individual ones of the series of rectangular opening 74 as may be seen in FIGS. 2 and 3.

It will be noted that each of the series of female contact fingers 13 and 14 includes a hump 106 (FIG. 1). Each of the contact fingers 13 and 14 would be engaged at about the hump 106, FIG. 1, at areas 107 and 108, respectively, by the appropriate surfaces of the rectangular openings 52 and 74.

The male member 12 of the connector 10 comprises a base, or support structure, 109 which may be of metal, if desired, within which is an opening 111 containing an insulating member 112 which supports the male contact fingers 15 and 16. In addition there may be one or more locating members 113 and 114 projecting from the surface 112 and being adapted to be received into appropriate holes 115 in the bottom member 32 (FIG. 1). Attached to the base member 109 is the operating member, or lever, 23 the attachment being by virtue of a screw 116 and a sleeve 117, the sleeve surrounding the screw 116 and the screw being turned into the threaded opening 118.

Thus when the female portion of the connector 11 is inserted into the opening 111 of the male portion 12 the operating lever 23 will have been pivoted counter clockwise to take it out of the way of the end 82 of the sliding bar cam member 22. After the female portion has received the male portion 12, the lever 23 is pivoted clockwise so that its inner edge 119 engages the cam surface 82 of the cam member 22 and forces the member 22 to move toward the right thereby causing the contact members 13 and 14 to engage the male contact members 15 and 16 as will be more fully described. After the lever 23 has been pivoted fully clockwise the latching lever 121 may be pivoted counter clockwise until the groove 122 engages the pin 123 to hold the lever 23 in position.

Referring to FIG. 2, the cam members 19, 21, and 22 are shown in the positions in which these pieces would occupy when the female connector portion 11 has received the male connector portion 12 but before the camming means has taken effect. Thus, in this figure, there may be seen the male contact fingers 15 and the counterpart female contact fingers 13 disposed in the rectangular openings 52 of cam part 19, and the male contact fingers 16 and the counterpart female contact fingers 14 disposed in the rectangular openings 74 of cam piece 21.

Thus when the operating arm 23 is moved clockwise, it forces the angular surface 82 of sliding bar (cam member) 22 to move toward the right against the bias of spring 27, thereby bringing the edges 97 and 98 into contact with the angular cam surfaces 79 and 81. The edges 97 and 98 moving against the angled surfaces 79 and 81 cause the cam piece 21 to move upwardly in the direction of arrow head 73A, thereby bringing the edges 124 of the square holes 74 against the portions 108 of the female fingers 14. This urges the humps 106 of these fingers against the male contact fingers 16, thus making contact between the appropriate conductors in cables 17 and 18.

Motion of cam piece 21 in the direction of arrow head 73A brings the surfaces 75 and 76 into engagement with the angular surfaces 53 and 54 of the cam piece 19. In this motion of the cam piece 21, it is constrained to move only in the direction of the arrow head 73A by virtue of the end members 59 and 61 being confined by the edges 65 and 66 of the ledges 36 and 35 respectively (FIG. 1). Hence the cam piece 19 is forced to move toward the right as shown by the arrow head 58A, thereby bringing the edges 125 of rectangular openings 52 against the portions 107 of the female contact members 13 and causing their humps 106 to engage the male contact members 15. Consequently conductors connected to these contact fingers respectively in cables 17 and 18 will be connected.

In this condition the engagement of the humps of the female contact fingers with the male contact fingers exerts sufficient friction so that it becomes very difficult, if not impossible, for the male and female connector parts to be pulled apart. Nevertheless, motion towards the right of the cam member 22 causes the end 83 thereof to be received in the hole 126 to assist in retaining the two connector parts together. It will be noted that by the single motion to the right of the cam member 22 it has caused the cam member 21 to be moved in one direction (arrow head 73A) and the cam member 19 to be moved in a direction at right angles thereto (arrow head 58A).

When it is desired to separate the two contact members, the latching lever 121 is pivoted out of the way followed by counter clockwise pivoting of the actuating lever 23 whereupon the biasing spring 27 moves the cam member 22 toward the left (FIG. 1). This permits the cam pieces 21 and 19 to move oppositely to the direction of arrow heads 73A and 58A, respectively, thereby separating the female and male contact fingers 13, 15 and 14, 16.

Thus, the two connector units may be connected and disconnected in a passive actuation manner with little frictional force. Minimized contact wear and load requirements are achieved, two plane motion is achieved with a single contact actuating mechanism, minimum connector insertion and removal forces are provided for, and the motion of the connecting wires has, in essence, been eliminated.

While a preferred embodiment of the invention has been described, it should be apparent to those skilled in the art, that many modifications and variations are possible, all of which fall within the spirit and scope of the invention.

We claim:

1. A zero-insertion-withdrawal force connector assembly comprising:

a first connector block having first and second contact fingers projecting therefrom, the planes of said first contact fingers being disposed at right angles to the planes of said second contact fingers, a second connector block having third and fourth contact fingers projecting therefrom, the planes of said third contact fingers being disposed at right angles to the planes of said fourth contact fingers, said second connector block being adapted to be disposed adjacent said first connector block with said third contact fingers lying alongside said first contact fingers but out of contact therewith and with said fourth contact fingers lying alongside said second contact fingers but out of contact therewith, first means for moving said first and third contact fingers into engagement with each other in one direction, second means for moving said second and fourth contact fingers into engagement with each other at right angles to the movement of said first means, relative movement interengaging means between said first means and said second means for effecting movement of said first means at right angles to the movement of said second means and in response thereto when said second means is moved, and third means for moving said second means.

2. The zero force connector according to claim 1 wherein said first means, said second means and said interengaging means are disposed in the same plane.

3. The zero force connector according to claim 1 wherein said third means comprises first cam means on said second means and cam operating means.

4. The zero force connector according to claim 3 wherein said interengaging means comprises second cam means on said second means and third cam means on said first means.

5. The zero force connector according to claim 3 wherein said first cam means are disposed in the same plane as said second means.

6. The zero force connector according to claim 3 wherein said cam operating means includes surfaces for engaging said first cam means, and including means for operating said cam operating means.

7. The zero force connector according to claim 6 including first housing means for said first connector block, said first means, said second means and said cam operating means, and a second housing for said second connector block, said second housing being adapted to operatingly support said means for operating said cam operating means.

* * * * *